United States Patent [19]

Baumann

[11] 4,382,487

[45] May 10, 1983

[54] EXHAUST MUFFLER OF ENAMELLED STEEL SHEET METAL AND METHOD OF PRODUCING IT

[76] Inventor: Werner Baumann, Jahnstrasse 2, D-8450 Amberg, Fed. Rep. of Germany

[21] Appl. No.: 229,597

[22] PCT Filed: Apr. 25, 1980

[86] PCT No.: PCT/DE80/00055

§ 371 Date: Dec. 30, 1980

§ 102(e) Date: Dec. 29, 1980

[87] PCT Pub. No.: WO80/02439

PCT Pub. Date: Nov. 13, 1980

[30] Foreign Application Priority Data

Apr. 30, 1979 [DE] Fed. Rep. of Germany ..... 2917586

[51] Int. Cl.[3] ..... F01N 7/16; F01N 7/18

[52] U.S. Cl. ..... 181/282; 181/245; 181/258; 181/272

[58] Field of Search ..... 181/243–252, 181/258, 272, 282

[56] References Cited

U.S. PATENT DOCUMENTS

| | | | |
|---|---|---|---|
| 2,229,526 | 1/1941 | Eric . | |
| 3,107,748 | 10/1963 | Placek et al. | 181/245 |
| 3,209,862 | 10/1965 | Young | 181/245 |
| 3,507,357 | 4/1970 | Blome | 181/282 |

FOREIGN PATENT DOCUMENTS

| | | |
|---|---|---|
| 135449 | 11/1901 | Fed. Rep. of Germany . |
| 2063644 | 7/1971 | Fed. Rep. of Germany . |
| 2130640 | 12/1972 | Fed. Rep. of Germany . |
| 106418 | 12/1974 | Fed. Rep. of Germany . |
| 7539530 | 12/1975 | Fed. Rep. of Germany . |
| 1093179 | 11/1967 | United Kingdom . |

*Primary Examiner*—Benjamin R. Fuller
*Attorney, Agent, or Firm*—Jacobs & Jacobs

[57] ABSTRACT

The invention relates to an exhaust muffler made of enamelled sheet steel, which is composed of a plurality of structural parts in which the structural parts of the muffler are coated with enamel slick, are then put together and heated to enamelling temperature, with the contacting surfaces of the structural parts thus fusing and in that way being securely connected together. Such structural parts include two head pieces provided with connection pipes which are positioned on the exhaust muffler sheath, as well as sound absorbing elements disposed inside the muffler. The head pieces and the sound absorbing elements arranged on the inside of the sheath, are connected with the sheath by means of connection surfaces located on the peripheral edges of the head pieces and the sound absorbing elements which are bent over parallel to the wall of the sheath. Between these various surfaces enamel slick is applied, whereby these members are connected together upon firing. The enamel slick in the connection region of the structural parts is partially reacted in a pre-firing step, with a complete fusing together of the structural parts being achieved in an after-firing. A third enamelling imparts additional properties.

4 Claims, 8 Drawing Figures

EXHAUST MUFFLER OF ENAMELLED STEEL SHEET METAL AND METHOD OF PRODUCING IT

Figure 1:
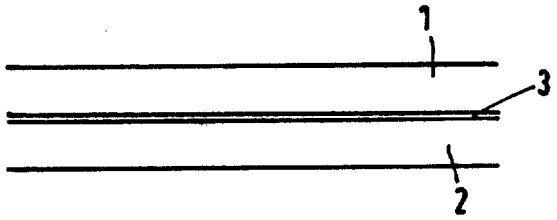

The invention relates to an exhaust muffler of enamelled steel sheet metal, which is composed of a plurality of structural parts, as well as to a method of producing it.

As a rule, exhaust mufflers of steel sheet metal are produced according to two methods, namely on the one hand in that a cylindrical sheath is folded or welded together lengthwise, whereupon head discs are rolled or welded onto the end faces of the sheath, into which discs gas inlet and gas outlet pipes are in turn welded. On the other hand, the production of the exhaust muffler takes place in a manner such that two mirror-inverted half shells are deep-drawn, which have a peripheral flange, on which the half shells, after they have been placed one above the other, are welded together by means of a seam welding machine.

The reverberation sound absorber of any exhaust system is subjected to corrosion from the inside by the condensate, particularly upon operation over short distances, the condensate resulting as an aspect inherent in the process upon combustion of the fuel/air mixture in the engine. Non-protected iron sheet metal quickly begins to rust and has rusted through within a short period of time, unless protected from such a corrosive attack. Enamelling the steel sheet metal is an inexpensive way of providing the iron with a heat-resistant and long-term resistant protective coating.

The above-mentioned production processes for exhaust mufflers for automobiles and the like, however, are not suited for producing enamelled mufflers because an enamelled part can substantially no longer be subsequently welded. Even though an edge can be provided on such a member, which edge is not enamelled, the temperatures required for welding this edge together with an other member nevertheless are so high that thermal stresses between the seam and the enamelled surface lead to chipping of the enamel when the mentioned parts enter into direct contact. It is not possible to weld the parts together at a spacing. Furthermore, an enamelled surface cannot be bent such that it can be folded together, such as is required in the case of the production process mentioned first at the outset.

It has for these reasons been attempted again and again to subsequently enamel the exhaust muffler produced of iron sheet metal. The inside space of the exhaust muffler has for this purpose been flooded with enamel slick, and the slick has been removed from the muffler, after a corresponding shaking and agitation operation, also under utilization of auxiliary apertures. The result could not satisfy, however, because, on the one hand, it could not be ensured that all of the inside surfaces had actually become coated with enamel and that apertures or the like, which must be provided for whirling the exhaust gas and for balancing the pressure impacts, have not become clogged with enamel and because, on the other hand, the inner parts of the muffler can in production not attain the enamelling temperature without the sheath enveloping the inner parts being burned through. Furthermore, the customary folding and weld seam connections cannot be faultlessly enamelled either.

Hence, it is the object of the invention to develop an enamelled exhaust muffler as well as a method of producing it, neither the muffler nor the method involving the above-mentioned drawbacks and making sure that all structural parts reach the required enamelling temperatures and are securely connected to one another, without there being any need to fear that not all of the inner surfaces of the muffler are coated with enamel and that apertures provided are clogged by enamel.

According to the invention, this object is accomplished in that the individual structural parts which the enamelled exhaust muffler consists of are placed together and are fused together at their surfaces of contact by the enamel.

In order to produce such an exhaust muffler, the structural parts of the muffler are coated with slick, are then put together and heated to enamelling temperature, the contacting surfaces of the structural parts thus fusing and in that way being securely connected with one another. Hence, no particular means, such as folding or welding, is required for connecting these structural parts; rather, this takes place by means of the enamel slick itself. For this purpose, the enamelled exhaust muffler, which according to an advantageous embodiment consists of two head pieces with connecting pipes, which are positioned on a sheath of steel sheet metal on the inside of which sound absorbing elements are arranged, may be provided with flange-like connection surfaces on the peripheral edges of the head pieces and the sound absorbing elements. These connecting surfaces are bent over parallel to the wall of the sheath, and enamel slick slides between their surfaces facing the sheath and the sheath surface, through which slick these parts are securely connected together upon the firing process.

According to an other advantageous embodiment of the enamelled exhaust muffler according to the invention, said muffler may consist of two shells with a circumferential overlap, by means of which the two shells are securely connected together through the enamel. These two shells are expediently held at a certain spacing by means of the dampening elements in the form of intermediate walls, which elements are inserted into the muffler.

In this connection, there also is the possibility to pre-enamel at least one of the structural parts of the muffler in the region, in which the parts are connected together and, for this purpose, to provide as enamel a material which first completely reacts upon subsequent firing, with the adherence between the structural parts to be securely connected together still being improved thereby because the finish-reacting enamel lets gas bubbles escape, which causes, as it were, a tooth-formation between the contacting enamel layers.

According to an other advantageous embodiment of the suggestion made by the invention, a further improvement in adherence between the structural parts of the muffler to be connected together can be achieved in that, in the region of connection of the structural parts, an enamel slick is employed which partially reacts upon pre-firing, and in that the structural parts upon subsequent firing under addition of a third enamel imparting additional properties are completely fused together.

The sound absorbing elements of the exhaust muffler, which can generally be termed detachable accessories, may be perforated in a manner such that the apertures on the front sheet metal side have a rounded inflow and on the back sheet metal side have material pieces turned outwardly, which are directed into or oppositely to the exhaust gas flow. Such material pieces may also form a cylindrical neck or they may be torn out, uneven structures which, if desired, may be bent over flatly to form an aperture passage that is rounded on both sides.

It has furthermore proven useful to utilize in the place of or simultaneously with assembly parts consisting of sheet metal such consisting of ceramic shaped members, which may for example be discs having a thickness of 5 to 25 mm and an aperture diameter of 3 to 80 mm. The peripheral surfaces of such ceramic shaped members can be pre-enamelled.

The use of stainless steel wool within the muffler has proved to be serviceable in order to improve the dampening effect of the exhaust muffler, which wool is securely fused to the muffler sheath or, respectively, to the wall of the pipe conducting the exhaust gas.

Further advantageous embodiments of the enamelled exhaust muffler according to the invention are chacterized by the subclaims.

Advantageous variations of the method for producing the exhaust muffler consisting of enamelled steel sheet metal provide for a pre-enamelling of the surfaces in the contact regions, in which respect an enamel may also be used which first completely reacts upon subsequent firing.

From among the other advantageous variations of the method that are characterized in the subclaims, primarily one is to be mentioned, which provides for a carrier layer being provided on the enamel of the exhaust muffler serving to carry substances, which change the physical and chemical properties of the muffler. Such substances may for example be agents that have a purifying effect on the exhaust gases.

Figure 2:
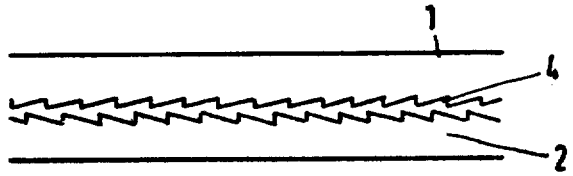
Figure 3:
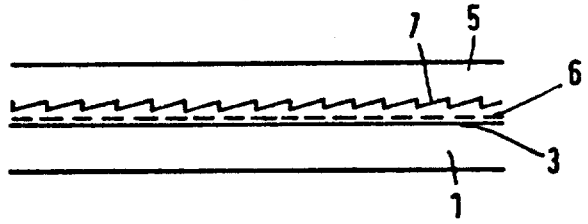
Figure 4:
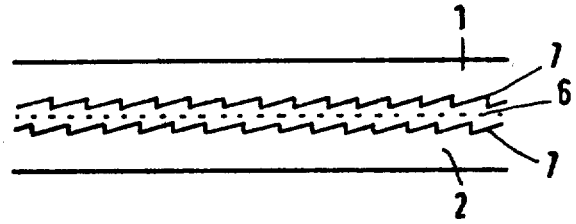
Figure 5:
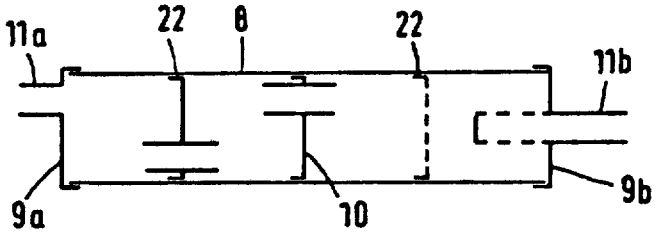
Figure 6:
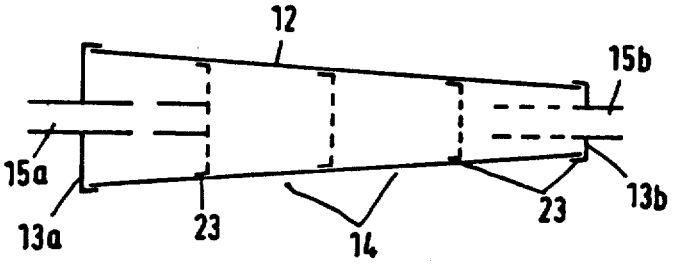
Figure 7:
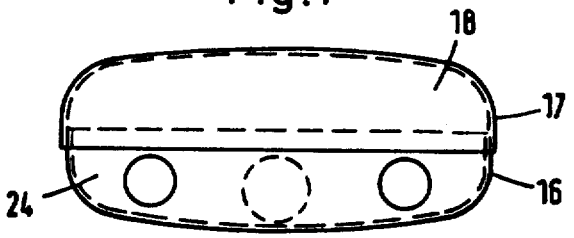
Figure 7:
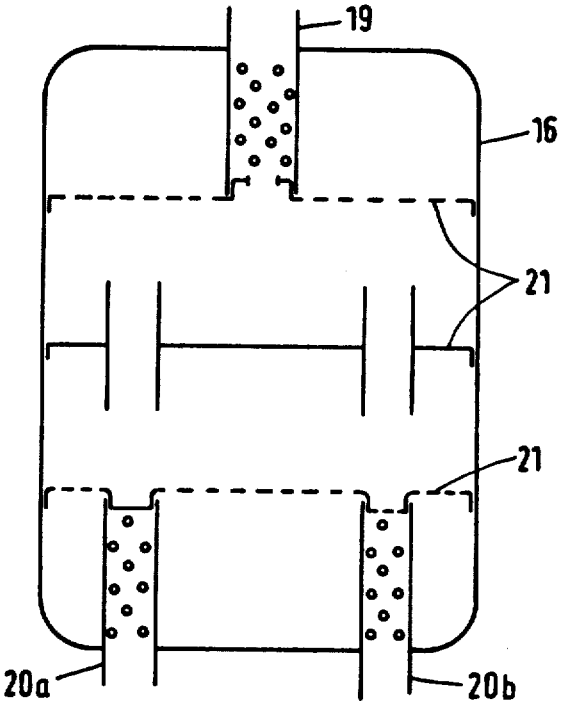
Figure 8:
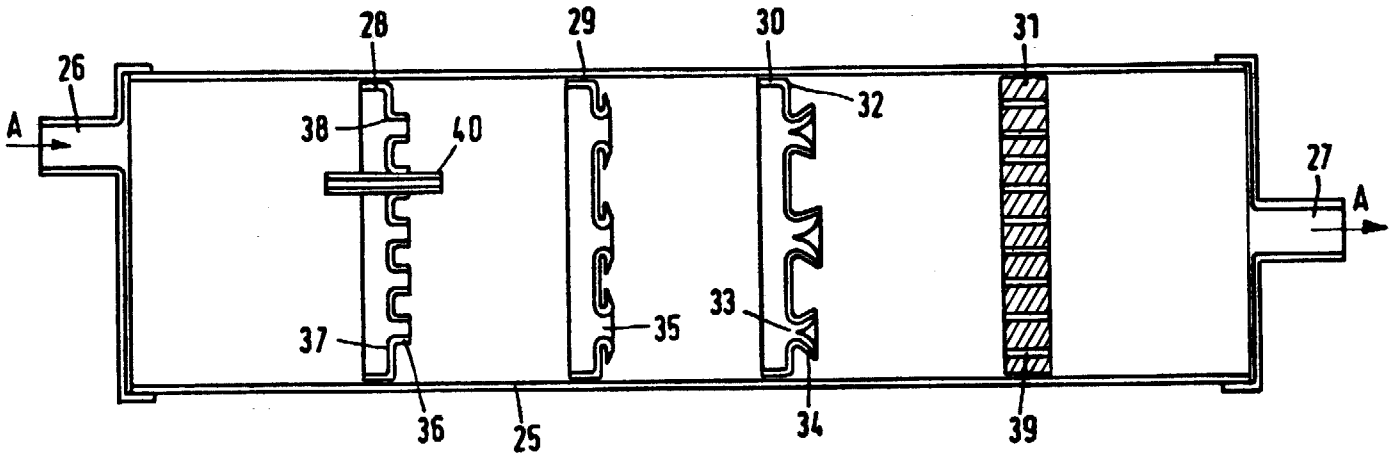

The invention will be explained in more detail below reverting to the exemplary embodiments shown in the drawing. The drawing shows in:

FIG. 1 a schematic representation of two iron sheet metals, between which there is located a base enamel layer that has not yet fused, FIG. 2 a representation similar to FIG. 1 of two iron sheet metals, in which the base enamel however has, by firing between 800° and 900° C., developed into an adhesive layer connecting the two sheets, FIG. 3 a representation similar to FIGS. 1 and 2, with the iron sheet being, however, pre-enamelled, FIG. 4 a schematic representation similar to that shown in FIGS. 1-3, with both iron sheet metals being, however, pre-enamelled, FIG. 5 a schematic representation of a longitudinal sectional view of an enamelled exhaust muffler having a cylindrical sheath and built-in sound absorbing elements, FIG. 6 a schematic representation of the longitudinal section of an enamelled exhaust muffler having a conical sheath and built-in sound absorbing elements, FIG. 7 a schematic representation in front elevation and sectional plan view of an enamelled exhaust muffler consisting of two shells provided with a circumferential overlap and FIG. 8 a schematic representation on an enlarged scale of a longitudinal sectional view of an enamelled exhaust muffler having a cylindrical sheath and various built-in detachable accessories.

Enamelling of iron takes place in per se known manner such that at first a so-called base enamel, i.e. a ground silicate melt with adhesive oxides (cobalt, nickel and others) and further adhesion promoters, is placed onto the iron. The enamel is worked up with clay to form a paste, which is also termed slick, and is applied onto the iron. The enamel coat melts in the burning oven at 800° to 900° C. and in that regard attains a doughy-liquid state, in which respect it chemically reacts with the iron. Ion exchange takes place, with the iron atoms travelling in the direction of the melt and the cobalt atoms or other atoms travelling in the direction of the iron. In that respect, a hard oxidic intermediate layer is formed that is no longer releasable from the iron. Two iron surfaces placed on one another such that the base layers on both sides merge into one another in the melting process are securely without any gaps connected with one another as if with a brazing mixture.

FIG. 1 shows two iron metal sheets 1 and 2, between which there is disposed a not yet molten base enamel layer 3. FIG. 2 shows the same assembly after firing of the base enamel, which takes place at between 800° and 900° C. It will be seen that the sharp boundary still existing in FIG. 1 between the two iron metal sheets has disappeared after firing, and that the base enamel layer has developed into an intermediate layer, a so-called adhesion layer 4, which connects the two metal sheets with one another.

A compromise is for other reasons often required of a type such that one or even both metal sheets must be pre-enamelled. FIGS. 3 and 4 show such a system.

In FIG. 3 the numeral 5 designates the iron metal sheet carrying the pre-enamel layer 6. The adhesive layer 7 is disposed between the pre-enamel layer and the metal sheet. The initial reaction shown in FIG. 2 in this instance is possible only after the not pre-enamelled metal sheet 1.

In FIG. 4, both metal sheets 1 and 2 are provided with a pre-enamel 6, so that there also occur two adhesion layers 7 between the pre-enamel and the respective side of the metal sheet. The pre-enamel layers consisting of a silicate-type enamel are positioned between the two adhesion layers 7. In this case, it must be ensured by matching the softening points that the two enamel layers 7 fuse together homogeneously, so that the two surfaces 1, 2 are securely connected together. It has in that respect turned out to be of advantage to pre-enamel with a base enamel that has not yet finish-reacted and that then finish-reacts during main firing, with gas bubbles thus escaping causing, as it were, tooth-locking of the enamel layers to be fused together. Insofar as both structural parts are pre-enamelled, a third enamel layer could also be used in order to improve intermingling of the two opposing surfaces, with the third enamel layer solubilizing the two enamelled surfaces.

It is necessary to provide for pre-enamelling of the inner parts of the exhaust muffler, hence, particularly the sound absorbing elements such as can be seen from FIGS. 5 to 7 in the form of intermediate walls provided with holes, because the sheath of the muffler screens the radiation and the flow of heat for the inner part during the burning process such that there no longer is the required flow of enamel on those inner parts or a detrimental over-heating of the outer parts, hence particularly of the sheath, would occur.

There is the possibility to compose the base enamel in a manner such that it exhibits variously long adhesive layer development times. An obvious way for causing good interflow of the adhesion layers of the pre-enamelled part and the part being enamelled for the first time is to adjust the enamel for the pre-enamelling such that it has not yet fully and completely reacted after the first firing operation. Using different adhesion layer development times has proven to be of advantage especially when processing varying metal sheet thicknesses.

FIG. 5 shows a schematic longitudinal sectional view of an enamelled exhaust muffler having a cylindrical sheath 8 of circular cross-section. The sheath 8 is longitudinally welded. A head piece 9a, 9b each is located at the end faces, each head piece having a connection pipe 11a, 11b welded thereto. On the inside of the muffler there are disposed in known manner sound absorbing elements 10 and resonance chamber walls that are provided with holes and perforations. Flange-like connecting surfaces 22, which are bent over parallel to the wall of the sheath 8, are arranged on the peripheral edges of the head pieces 9a, 9b and of the sound dampening elements 10. Now when the respective parts are assembled with the sheath, enamel slick slides between the surfaces of these connecting areas, which surfaces face the sheath 8, and the sheath surface. In the firing process, the opposing areal portions of the sheath and of the connecting surfaces of the head pieces and sound dampening elements are fused together by the enamel slick and are in this way securely connected together.

The exhaust muffler shown schematically in longitudinal section in FIG. 6 has a conical or cone-shaped configuration, which is distinguished by less marked resonance frequencies, and which can be produced in a particularly simple manner by fusing together the individual structural parts, hence the dampening elements 14 disposed within the conical sheath 12 with their flange-like connecting surfaces 23 and the head pieces with the cone sheath 12, which head pieces are provided with welded-in connection pipes 15a, 15b and also have flange-like connection elements 23. The conical shape of the sheath in a particularly reliable manner leads to a close fit of the structural parts that is conducive to fusion and durability. As in the case of the embodiment according to FIG. 5, enamel slick also in this case slides upon assemblage of the parts between the connection surfaces and the sheath surface, which then upon firing leads to the structural parts fusing together with the inner sheath side.

As shown in FIGS. 1–4, it is possible in the case of these design embodiments to attain, by means of pre-enamelling and suitable adjustment of the adhesion layer development times, sufficiently secure connections between the structural parts also in those cases, in which heating of the structural parts meets with difficulties because the exhaust muffler sheath during the firing process impairs the flow of heat to the inside of the muffler. Pre-enamelling of the structural parts located on the inside of the muffler can also be carried through by means of a particularly resistant enamel.

Furthermore, design embodiments are conceivable, in which the enamel of the exhaust muffler has a carrier layer for substances, which change the physical and the chemical properties of the muffler.

The exhaust muffler design of an after-sound absorber as shown in FIG. 7 includes two nested half shells 16, 17, which are held at a desired spacing by means of damping elements in the form of intermediate walls 21 inserted into the muffler, at which distance said half shells overlap along their edge 24. Usefully, the gas inlet and gas outlet pipes 19 or, respectively, 20a, 20b are inserted into the lower half shell 16 and are welded to the shell there. The chamber walls 21 as sound absorbing elements extend beyond the lower half shell 16 by the depth of the upper half shell 17, as can be gathered at 18 in FIG. 7 and at that location expediently have an overturn.

Hence, both half shells are open bodies, which can without any problem be enamelled and controlled; the lower half shell 16, which carries the damping elements, is pre-enamelled, and namely with the aid of the above-described techniques. The upper half shell 17 is then in wet state in which it is wetted with enamel slick slid on-to the lower half shell. This occurs to an extent until the half shell is positioned on the sound absorbing chamber walls 21. Upon subsequent firing of the half shells slid over one another, these then fuse together in the region 24 of contact by means of the enamel slick located there. The same thing takes place also in the region of contact of the connection surfaces of the chamber walls, which surfaces are bent over in flange-like manner, and which fuse together with the inner wall of the half shells, thus increasing the strength of the muffler and avoiding fluttering of the shell wall.

The assembly members provided as built-in structures on the inside of the exhaust muffler may, as is apparent from FIG. 6, have varying configuration depending upon the respective requirements in regard to sound absorbing, in which regard four different types of such built-in structures are shown by way of example, in order to simplify matters, in the representation of FIG. 8. It will be understood that the inside of the muffler may also be provided with a plurality of like built-in members 28, 29, 30, 31.

The built-in members (assembly parts) 28, 29 and 30 consist of sheet metal and are provided with holes 33 for passage of the exhaust gas, with the direction of flow of exhaust gas being indicated by the arrows A. The holes 33 have a rounded inflow 38 on the front side 37 of the metal sheet and on the backside 32 of the metal sheet they have material pieces 34, 36 that are turned outwardly and, as shown at 36, are capable of forming a cylindrical neck and, as shown at 34, constitute torn-out tag-like structures. For this purpose, the assembly parts before being built into the muffler sheath 25 are perforated by a conical punch at the locations to the holed, so that material pieces turned outwardly in the direction of flow of the exhaust gas or, as not shown in FIG. 8, respectively directed against the flow direction of the exhaust gas, depending upon the position of assembly, are provided.

The pre-punched holes of the assembly parts are then further widened by means of a forming die, the diameter of which is larger than the hole which resulted from pre-punching, such that the cylindrical neck 36 bends outwardly and the hole at the same time is given a rounded inflow 38 on the front side 37 of the metal sheet.

The material pieces 34 bent outwardly like tags, such as they can be seen at the assembly part 30, can be flatly turned over with the aid of a cup-shaped die to form the hole passage 35 rounded on both sides shown in connection with the assembly part 29.

As already mentioned, the metal sheet of the exhaust muffler sheath 25 and/or the peripheral surface on the mutual points of contact can be pre-enamelled.

Ceramic molded members, for example in the form of the disc shown at 31 can also be used as assembly part, which shaped pieces have a thickness of between 5 and 25 mm and the holes 39 of which have a diameter of between 3 and 80 mm. The peripheral surfaces of such ceramic shaped pieces or discs may also be pre-enamelled in order to be fused with the inner wall of the muffler sheath.

Furthermore, there is the possibility to arrange stainless steel wool in the exhaust muffler to dampen the exhaust gas stream entering the muffler at 26 and leaving it at 27, which steel wool is securely fused to the inner wall of the muffler sheath 25. This possibility is not shown in the drawing. Furthermore, ceramic venturi throats or enamelled metal nozzles can also be fused into the exhaust muffler pipes, which throats or nozzles are temperature resistant and resistant to corrosion.

Another possibility of designing assembly parts in accordance with their purpose of use is shown in FIG. 8 in connection with the assembly part 28 by the utilization of a piece 40 of pipe that is slid through the cylindrical neck 36. All of the necks 36 of a perforated disc shown may of course be provided with such pipe pieces, with the assembly of the pipe pieces 40 in the assembly part 28 designed as perforated disc occurring prior to the assembly into the exhaust muffler, and the entire unit then is arranged in the muffler as a unit of assembly and is at its peripheral edge fused to the inner muffler wall through the enamel slick.

I claim:

1. An exhaust muffler of enamelled steel sheet, providing a sheath and having two ends which are closed by head pieces, and containing intermediate sound absorbing elements, structural parts of the muffler being attached to the wall of the sheath by means of slick enamel through fusing the enamel on the wall, characterized in that:

(a) the sound absorbing elements are structural parts attached to the sheath by fusing of the enamel, (b) the sound absorbing elements are intermediate walls pre-enamelled and having at their periphery edges with connecting surfaces bent over parallel to the inner wall of the sheath, (c) the intermediate walls are covered with an enamel finish-reacted in a subsequent firing step, and (d) the inner wall of the sheath is also pre-enamelled and covered with an enamel finish-reacted in a subsequent firing step.

2. An exhaust muffler according to claim 1, characterized in that the sheath consists of two shells having a circumferential overlap, and the two shells are connected together through the enamel.

3. An exhaust muffler according to claim 1, characterized in that the sound absorbing elements are connected to the sheath by addition of further enamel during a subsequent firing.

4. An exhaust muffler according to any of the preceding claims, characterized in that the uppermost layer of the enamel is a carrier layer for substances amending the physical and chemical properties of the material inside the sheath.

* * * * *